US010204588B2

(12) United States Patent
Liu et al.

(10) Patent No.: US 10,204,588 B2
(45) Date of Patent: Feb. 12, 2019

(54) TEMPERATURE COMPENSATION CIRCUIT, DISPLAY PANEL AND TEMPERATURE COMPENSATION METHOD

(71) Applicants: BOE Technology Group Co., Ltd., Beijing (CN); Beijing BOE Display Technology Co., Ltd., Beijing (CN)

(72) Inventors: Tianxing Liu, Beijing (CN); Bei Yang, Beijing (CN); Wen Li, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/544,972

(22) PCT Filed: Jan. 16, 2017

(86) PCT No.: PCT/CN2017/071264

§ 371 (c)(1),
(2) Date: Jul. 20, 2017

(87) PCT Pub. No.: WO2017/190532

PCT Pub. Date: Nov. 9, 2017

(65) Prior Publication Data

US 2018/0158428 A1 Jun. 7, 2018

(30) Foreign Application Priority Data

May 6, 2016 (CN) ..... 2016 1 0298599

(51) Int. Cl.
*G09G 3/36* (2006.01)

(52) U.S. Cl.
CPC ..... *G09G 3/3685* (2013.01); *G09G 3/36* (2013.01); *G09G 3/3696* (2013.01); *G09G 2320/041* (2013.01)

(58) Field of Classification Search
CPC .. G09G 2320/041; G09G 3/36; G09G 3/3685; G09G 3/3696

(Continued)

(56) References Cited

U.S. PATENT DOCUMENTS 6,037,920 A * 3/2000 Mizutome ..... G09G 3/3629 345/101
8,009,162 B2 * 8/2011 Takatori ..... G01K 1/14 257/467

(Continued)

FOREIGN PATENT DOCUMENTS

CN 101330252 A 12/2008
CN 102054455 A 5/2011

(Continued)

OTHER PUBLICATIONS

International Search Report and Written Opinion for International Application No. PCT/CN2017/071264, dated Apr. 19, 2017, 13 pages.

(Continued)

*Primary Examiner* — Tony O Davis
(74) *Attorney, Agent, or Firm* — Westman, Champlin & Koehler, P.A.

(57) ABSTRACT

Embodiments of the present disclosure provide a temperature compensation circuit, a display panel and a temperature compensation method. The temperature compensation circuit comprises: a temperature sensing unit, adapted to sense a temperature of an external environment; a temperature compensation control unit being adapted to compare the temperature sensed output voltage with a reference voltage, and generate a control signal based on the comparison result; and a first voltage source adapted to receive a control signal from the temperature compensation control unit, generate a corresponding driving voltage based on the control signal and output the corresponding driving voltage to a gate drive (Continued)

circuit as a gate driving voltage of the gate drive circuit, and generate a feedback signal according to the control signal and output the feedback signal to the temperature sensing unit and the temperature compensation control unit, the reference voltage being variable based on the feedback signal.

14 Claims, 4 Drawing Sheets

(58) Field of Classification Search
USPC ..... 345/211–214
See application file for complete search history.

(56) References Cited

U.S. PATENT DOCUMENTS 8,698,548 B2 * 4/2014 Nien ..... H02M 3/1588 327/512
9,647,661 B2 * 5/2017 Cui ..... H03K 19/00369
9,960,761 B2 * 5/2018 Cao ..... H03K 17/145
2007/0085806 A1 * 4/2007 Moon ..... G09G 3/3611 345/98
2007/0171956 A1 * 7/2007 Noguchi ..... G01K 7/01 374/100
2008/0309608 A1 * 12/2008 Shen ..... G09G 3/3696 345/101
2009/0102779 A1 * 4/2009 Jo ..... G09G 3/3696 345/101
2009/0237390 A1 * 9/2009 Koyama ..... G09G 3/3233 345/212
2011/0268151 A1 * 11/2011 Hadwen ..... B01L 3/502792 374/141
2012/0062526 A1 3/2012 Wen et al.
2012/0098815 A1 * 4/2012 Hou ..... G09G 3/3677 345/212
2012/0104229 A1 * 5/2012 Kwon ..... G01J 5/22 250/208.1
2012/0120125 A1 * 5/2012 Choi ..... G09G 3/3611 345/690
2013/0106827 A1 5/2013 Zhao et al.
2014/0111106 A1 * 4/2014 Wei ..... H05B 41/3925 315/200 R
2014/0168041 A1 6/2014 Chen et al.
2014/0368254 A1 * 12/2014 Lee ..... H03K 17/165 327/378
2015/0170601 A1 * 6/2015 Lee ..... G09G 3/3696 345/213
2015/0364078 A1 * 12/2015 Shim ..... G09G 3/2092 345/211
2016/0042691 A1 * 2/2016 Na ..... G09G 3/3266 345/205
2016/0293834 A1 * 10/2016 Polley ..... G01R 33/07

FOREIGN PATENT DOCUMENTS

CN 102368381 A 3/2012
CN 102915713 A 2/2013
CN 102982778 A 3/2013
CN 203456073 U 2/2014
CN 103869866 A 6/2014
CN 105741811 A 7/2016

OTHER PUBLICATIONS

English translation of International Search Report and Written Opinion for International Application No. PCT/CN2017/071264, dated Apr. 19, 2017, 12 pages.
Second Office Action from Chinese Patent Application No. 201610298599.0, dated Dec. 11, 2017, 18 pages.
First Office Action from Chinese Patent Application No. 201610298599.0, dated Sep. 18, 2017, 9 pages.

* cited by examiner

TEMPERATURE COMPENSATION CIRCUIT, DISPLAY PANEL AND TEMPERATURE COMPENSATION METHOD

CROSS-REFERENCE TO RELATED APPLICATION(S)

This application is a Section 371 National Stage Application of International Application No. PCT/CN2017/071264, filed on 16 Jan. 2017, which has not yet published, and claims priority to Chinese Application No. 201610298599.0, filed on May 6, 2016, entitled TEMPERATURE COMPENSATION CIRCUIT, DISPLAY PANEL AND TEMPERATURE COMPENSATION METHOD", the contents of which are hereby incorporated by reference in their entirety.

TECHNICAL FIELD

Embodiments of the present disclosure relate to liquid crystal display technology, and in particular, to a temperature compensation circuit, a display panel, and a temperature compensation method.

BACKGROUND

A panel of a thin film transistor (TFT) liquid crystal display (TFT-LCD) is affected by temperature. At a low temperature, characteristics of the TFT may shift, and a turn-on characteristic is reduced, thereby affecting a switching characteristic and a charging rate of the panel pixel TFT. Particularly for cells of a GOA (Gate on Array) product, a turn-on (On) voltage Von required for a TFT tube, which is used as a switch, in a gate drive circuit at the low temperature rises, which may cause the gate not to be turned on well. Therefore, in a design stage of a circuit, a self-stable-state temperature compensation loop is typically added. A traditional self-stable-state temperature compensation loop is implemented by means of a thermistor. When an ambient temperature is at a normal room temperature, the turn-on voltage Von required for the switch TFT tube in the gate drive circuit is relatively low. When the ambient temperature is reduced, resistance of the thermistor changes, a voltage drop across the thermistor or a current flowing through the thermistor is changed, so as to trigger the self-stable-state temperature compensation loop to start working, causing Von to rise to ensure a charging capacity of the pixels.

However, since the thermistor is typically arranged on a PCB of a drive panel, material and a surrounding environment of the PCB are different from those of a display panel, and their thermal conductivities are different, so that degrees of environmental impacts on them are inconsistent. In addition, the PCB is not directly exposed in the environment as the display panel, which causes that the thermistor and in turn the self-stable-state compensation circuit cannot reflect a temperature variation of the display panel correctly and promptly. Thus, a temperature compensation network cannot work accurately, which is easy to result in insufficient driving and charging capacity, and further leads to abnormal screen display and the like.

SUMMARY

According to one aspect of embodiments of the present disclosure, a temperature compensation circuit is provided, comprising:

a temperature sensing unit, adapted to sense a temperature of an external environment and generate a temperature sensed output voltage based on the sensed temperature of the external environment;

a temperature compensation control unit connected to the temperature sensing unit, the temperature compensation control unit being adapted to compare the temperature sensed output voltage with a reference voltage, and generate a control signal based on the comparison result; and a first voltage source connected to the temperature compensation control unit and the temperature sensing unit, the first voltage source adapted to receive a control signal from the temperature compensation control unit, generate a corresponding driving voltage based on the control signal and output the corresponding driving voltage to a gate drive circuit as a gate driving voltage of the gate drive circuit, and generate a feedback signal according to the control signal and output the feedback signal to the temperature sensing unit and the temperature compensation control unit, the reference voltage being variable based on the feedback signal.

According to an exemplary embodiment, the temperature sensing unit comprises a control terminal, an input terminal and an output terminal; the temperature compensation control unit comprises a first input terminal, a second input terminal and an output terminal; and the first voltage source comprises an input terminal, a first output terminal and a second output terminal, wherein the first input terminal of the temperature compensation control unit is connected to the output terminal of the temperature sensing unit, the second input terminal of the temperature compensation control unit is connected to the control end of the temperature sensing unit, and the output terminal of the temperature compensation control unit is connected to the input terminal of the first voltage source, and wherein the temperature compensation control unit compares an input voltage of its first input terminal with an input voltage of its second input terminal; and the first output terminal of the first voltage source is connected to the gate drive circuit, the second output terminal of the first voltage source is connected to the control terminal of the temperature sensing unit and the second input terminal of the temperature compensation control unit, and the first voltage source outputs the corresponding driving voltage to the gate drive circuit via the first output terminal and outputs the feedback signal to the control terminal of the temperature sensing unit and the second input terminal of the temperature compensation control unit via the second output terminal.

According to an exemplary embodiment, the temperature compensation circuit further comprises a second voltage source connected to the input terminal of the temperature sensing element, adapted to provide a constant operating voltage to the temperature sensing unit.

According to an exemplary embodiment, the temperature sensing unit comprises a plurality of temperature sensing elements which are thin film transistors, gates, sources and drains of the thin film transistors being respectively connected together to form a common gate, a common source and a common drain respectively, the common gate of the thin film transistors being the control terminal of the temperature sensing unit, one of the common source and the common drain of the thin film transistors being the input terminal of the temperature sensing unit, and the other of the common source and the common drain of the thin film transistors being the output terminal of the temperature sensing unit.

According to an exemplary embodiment, the first voltage source comprises a charge pump circuit which generates the corresponding driving voltage based on the control signal and outputs to the gate drive circuit, and generates the feedback signal according to the control signal and outputs to the control terminal of the temperature sensing unit and the second input terminal of the temperature compensation control unit.

According to an exemplary embodiment, the temperature compensation control unit comprises a comparator, an in-phase input terminal of the comparator receiving the temperature sensed output voltage from the temperature sensing unit, an out-of-phase input terminal of the comparator receiving the reference voltage, and an output terminal of the comparator outputting the control signal.

According to an exemplary embodiment, the temperature compensation control unit further comprises a third resistor and a fourth resistor, the control terminal of the temperature sensing unit being connected to the out-of-phase input terminal of the comparator via the fourth resistor, and the output terminal of the temperature sensing unit being connected to the in-phase input terminal of the comparator via the third resistor.

According to an exemplary embodiment, the temperature compensation control unit further comprises a second resistor and a fifth resistor, the output terminal of the temperature sensing unit being grounded via the second resistor, and the out-of-phase input terminal of the comparator being grounded via the fifth resistor.

According to an exemplary embodiment, a parameter of the feedback signal is set according to characteristics of a Temperature-Turn-on curve of the temperature sensing unit.

According to another aspect of the embodiments of the present disclosure, a display panel is provided, the display panel comprising a display region and a non-display region, and further comprising the temperature compensation circuit according to the embodiment of the present disclosure, adapted to perform temperature compensation for the gate driving voltage of the gate drive circuit of the display panel, wherein the temperature sensing unit is arranged in the non-display region of the display panel. The non-display region may be glass of the display panel.

According to an exemplary embodiment, the temperature sensing unit comprises a plurality of thin film transistors which are uniformly arranged in the non-display region in a form of an array.

According to another aspect of the embodiments of the present disclosure, a temperature compensation method for a gate driving voltage is provided, which may be applied to the display panel according to the embodiment of the present disclosure. The temperature compensation method may comprise:

inputting, by the temperature sensing unit, the temperature sensed input voltage to the first input terminal of the temperature compensation control unit, according to the temperature of the external environment and a voltage of the control terminal;

comparing, by the temperature compensation control unit, the temperature sensed output voltage with the reference voltage; generating the control signal according to the comparison result; and outputting the control signal to the first voltage source;

outputting, by the first voltage source, the corresponding driving voltage to the gate drive circuit of the display panel as the gate driving voltage, according to the control signal;

generating, by the first voltage source, the feedback signal according to the control signal, and outputting the feedback signal to the temperature sensing unit as the voltage of the control terminal of the temperature sensing unit; and inputting, to the second input terminal of the temperature compensation control unit, the reference voltage which is variable based on the feedback signal.

According to an exemplary embodiment, generating, by the temperature compensation control unit, the control signal according to the comparison result comprises: generating a control signal which indicates that the first voltage source needs to compensate for the gate driving voltage, when the temperature compensation control unit determines that the temperature sensed output voltage is less than the reference voltage; and generating a control signal which indicates that the first voltage source does not need to compensate for the gate driving voltage, when the temperature compensation control unit determines that the temperature sensed output voltage is no less than the reference voltage.

According to an exemplary embodiment, the first voltage source generates the feedback signal according to the control signal, so as to increase the voltage of the control terminal; and inputs an increased reference voltage to the second input terminal of the temperature compensation control unit, based on the feedback signal.

DETAILED DESCRIPTION

Hereinafter, the technical solutions of the embodiments of the present disclosure will be described in detail with reference to the drawings. It should be noted that throughout the drawings, the same elements are denoted by the same or similar reference numbers. It is to be understood by the skilled in the art that the description "A and B are connected" and "A is connected to B" herein may mean that A is directly connected to B, or A is connected to B via one or more other components. In addition, "being connected" and "being connected to" herein may be physically electrically connected, or may be electrically coupled.

Figure 1:
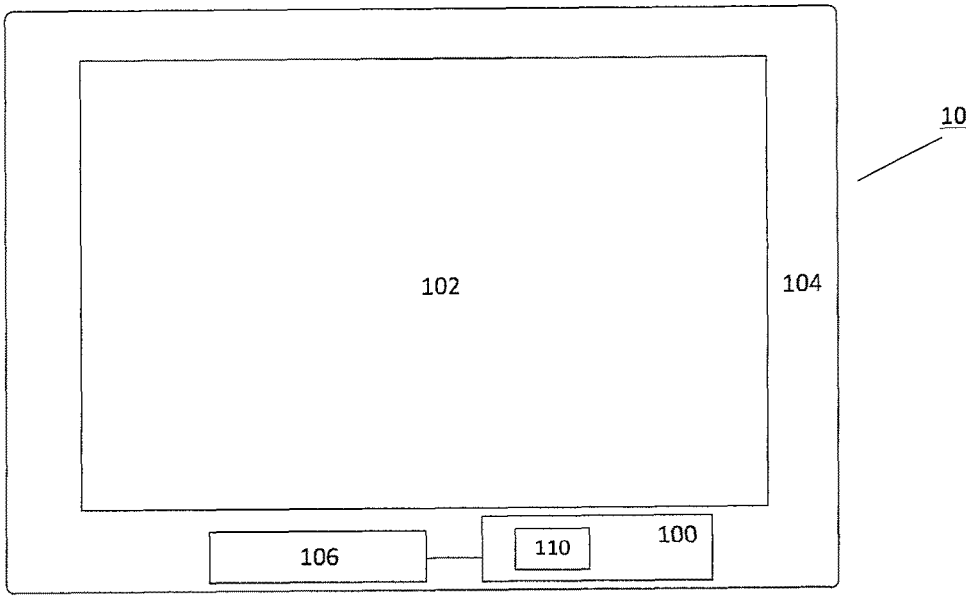
FIG. 1 shows a schematic structure diagram of a display panel according to an embodiment of the present disclosure.

FIG. 1 shows a schematic structure diagram of a display panel 10 according to an embodiment of the present disclosure. The display panel comprises a display region 102 and a non-display region 104. The display panel 10 further comprises a temperature compensation circuit 100 according to an embodiment of the present disclosure. The temperature compensation circuit 100 is used for performing temperature compensation for a gate driving voltage of a gate drive circuit 106, wherein the temperature compensation circuit 100 comprises a temperature sensing unit 110 arranged in the non-display area 104 of the display panel 10.

It is to be noted that the temperature compensation circuit 100 in FIG. 1 is just illustrative, but does not limit the configuration and the structure of the temperature compensation circuit according to the present disclosure. For example, FIG. 1 just shows that the temperature compensation circuit 100 comprises the temperature sensing unit 110, but the temperature compensation circuit 100 may also comprise other elements for implementing the temperature compensation function. In FIG. 1, the temperature compensation circuit 100 is shown as being directly connected to the gate drive circuit, but other elements may be arranged between them. In FIG. 1, the temperature compensation circuit 100 is shown as entirely located on the non-display region 104, but a part of the temperature compensation circuit 100 may also be located on the display region 102 or other parts of the panel 10 than the display region 102 and the non-display region 104.

Figure 2A:
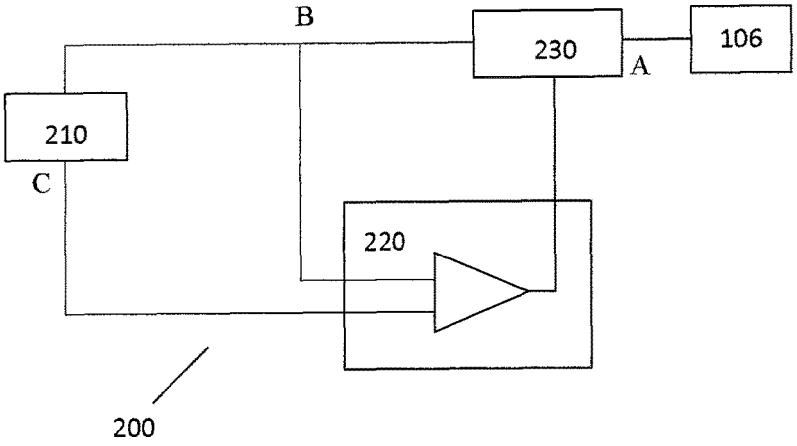
FIG. 2A shows a schematic block diagram of a temperature compensation circuit according to an embodiment of the present disclosure.

Next, a temperature compensation circuit 200 according to an embodiment of the present invention will be described in detail with reference to FIG. 2A. As shown in FIG. 2A, the temperature compensation circuit 200 may comprise a temperature sensing unit 210, a temperature compensation control unit 220, and a first voltage source 230. The temperature sensing unit 210 is used for sensing a temperature of an external environment and generating a temperature sensed output voltage based on the sensed temperature of the external environment. The temperature compensation control unit 220 is connected to the temperature sensing unit 210, compares the temperature sensed output voltage with a reference voltage, and generates a control signal based on the comparison result. The first voltage source 230 is connected to the temperature compensation control unit 220 and the temperature sensing unit 210. The first voltage source 230 receives the control signal from the temperature compensation control unit 220, generates a corresponding driving voltage based on the control signal, and outputs the corresponding driving voltage to the gate drive circuit 106 as a gate driving voltage of the gate drive circuit 106. The first voltage source 230 also generates a feedback signal based on the control signal, and outputs the feedback signal to the temperature sensing unit 210 and the temperature compensation control unit 220. The reference voltage is variable based on the feedback signal.

Figure 2B:
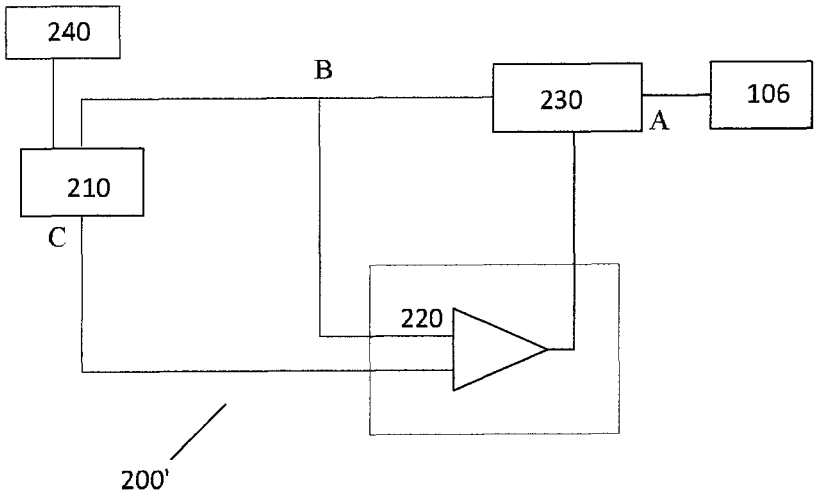
FIG. 2B shows a schematic block diagram of a temperature compensation circuit according to another embodiment of the present disclosure.

FIG. 2B shows a temperature compensation circuit 200' according to another embodiment of the present disclosure. As shown in FIG. 2B, the temperature compensation circuit 200' further comprises a second voltage source 240, besides the temperature sensing unit 210, the temperature compensation control unit 220 and the first voltage source 230 as shown in FIG. 2A. The second voltage source 240 is connected to the temperature sensing unit 210 to provide a constant operating voltage to the temperature sensing unit.

According to the embodiment of the present disclosure, the temperature sensing unit 210 may comprise a control terminal, an input terminal, and an output terminal. The temperature compensation control unit 220 may comprise a first input terminal, a second input terminal, and an output terminal, and the first voltage source 230 may comprise an input terminal, a first output terminal, and a second output terminal. The first input terminal of the temperature compensation control unit 220 is connected to the output terminal (node C) of the temperature sensing unit 210. The second input terminal of the temperature compensation control unit 220 is connected to the control terminal of the temperature sensing unit 210, and the output terminal of the temperature compensation control unit 220 is connected to the input terminal of the first voltage source 230. The temperature compensation control unit 220 compares an input voltage of its first input terminal and an input voltage of its second input terminal, generates the control signal based on the comparison result, and supplies the control signal to the first voltage source 230 via the output terminal of the temperature compensation control unit 220. The first output terminal (node A) of the first voltage source unit 230 is connected to the gate drive circuit 106 of the display panel, the second output terminal of the first voltage source 230 is connected to the control terminal (node B) of the temperature sensing unit 210 and the second input terminal of the temperature compensation control unit 220. The input terminal of the first voltage source 230 receives the control signal from the temperature compensation control unit 220. The first voltage source 230 generates a corresponding driving voltage based on the control signal, and outputs the corresponding driving voltage to the gate drive circuit. Specifically, in a case that the control signal indicates that the driving voltage needs to be compensated, the first voltage source 230 compensates for the gate driving voltage, and outputs the compensated driving voltage to the gate drive circuit as the gate driving voltage of the gate drive circuit. In a case that the control signal indicates that the driving voltage does not need to be compensated, the first voltage source 230 does not compensate for the gate driving voltage, and outputs the gate driving voltage to the gate drive circuit. In addition, the first voltage source 230 also generates a feedback signal based on the control signal, and outputs the feedback signal to the control terminal of the temperature sensing unit 210 and the second input terminal of the temperature compensation control unit 220 via the second output terminal of the first voltage source 230. As shown in FIG. 2B, the second voltage source 240 may be connected to the input terminal of the temperature sensing unit 210 to provide the temperature sensing unit 210 with a constant operating voltage required for a normal operation.

In FIGS. 2A and 2B, the temperature compensation control unit 220 comprises a comparator. However, it should be understood that the temperature compensation control unit 220 may also be other elements capable of realizing the same function. A first input terminal of the comparator receives the temperature sensed output voltage from the temperature sensing unit 210, and a second input of the comparator receives the reference voltage which is based on the feedback signal. The comparator compares the temperature sensed output voltage with the reference voltage, and generates the control signal based on the comparison result. An output terminal of the comparator outputs the control signal to the first voltage source 230.

Figure 3:
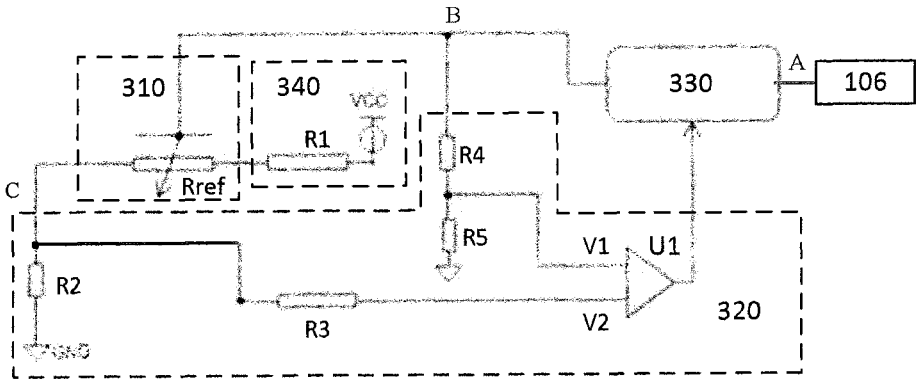
FIG. 3 shows a schematic circuit diagram of a temperature compensation circuit according to an embodiment of the present disclosure.
Figure 4:
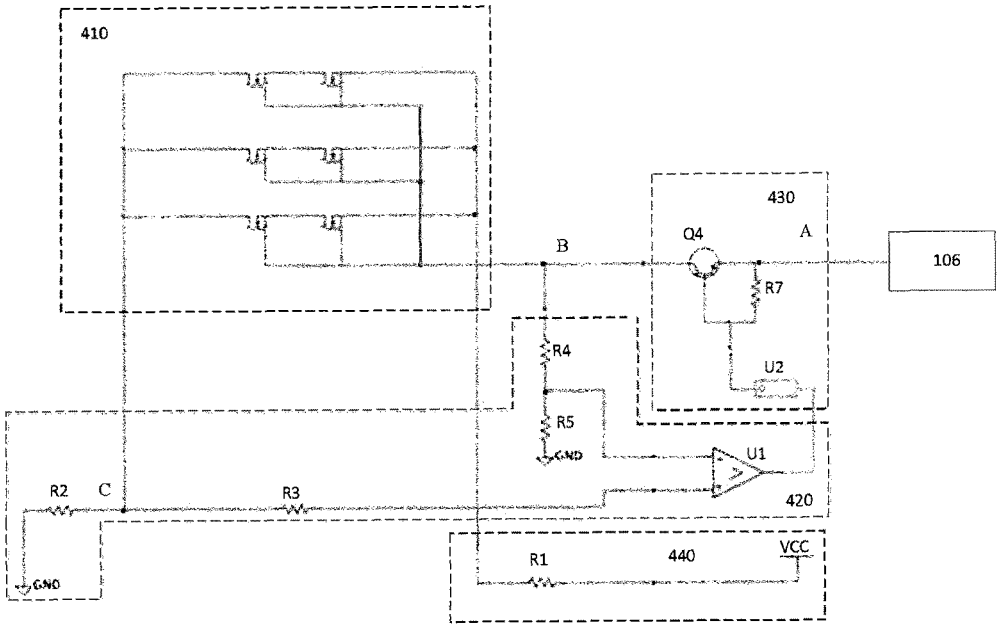
FIG. 4 shows a schematic circuit diagram of a temperature compensation circuit according to another embodiment of the present disclosure.

FIG. 3 shows a schematic circuit diagram of a temperature compensation circuit according to an embodiment of the present disclosure, and FIG. 4 shows a circuit diagram of a temperature compensation circuit according to another embodiment of the present disclosure. Hereinafter, the temperature compensation circuit according to the embodiments of the present disclosure will be further described with reference to FIGS. 3 and 4.

As shown in FIG. 3, a temperature compensation circuit according to an embodiment of the present disclosure may comprise a temperature sensing unit 310, a temperature compensation control unit 320, a first voltage source 330, and a second voltage source 340. The temperature sensing unit 310 may comprise a plurality of temperature sensing elements. The plurality of temperature sensing elements may be a plurality of thin film transistors, wherein gates, sources and drains of the thin film transistors are respectively connected together to form a common gate, a common source and a common drain of the thin film transistors. The common gate of the thin film transistors is the control terminal of the temperature sensing unit 310. One of the common source and the common drain of the thin film transistors is the input terminal of the temperature sensing unit 310, and the other of the common source and the common drain of the thin film transistors is the output terminal of the temperature sensing unit 310. For ease of description, the temperature sensing unit 310 is shown in FIG. 3 as a variable equivalent turn-on resistance Rref of the plurality of thin film transistors. As shown in FIG. 4, the thin film transistor is arranged uniformly in the non-display region of the display panel in a form of an array. The non-display region may be glass of the display panel. The thin film transistor may have the same specification as a driving TFT of the gate drive circuit so as to be able to reflect, consistently with the gate drive circuit, variation of the temperature of the ambient environment by variation of the variable equivalent turn-on resistance Rref (and thus variation of a turn-on current).

The second voltage source 340 may comprise a voltage source VCC and a first resistor R1. The input terminal of the temperature sensing unit 310 is connected to VCC which is a constant voltage via the first resistor R1, so that the temperature sensing unit 310 can operate normally.

As shown in FIG. 3, the temperature compensation control unit 320 may comprise a comparator U1, a second resistor R2, a third resistor R3, a fourth resistor R4, and a fifth resistor R5. The output terminal (node C) of the temperature sensing unit 310 is connected to the first input terminal V2 of the comparator U1 via the third resistor R3, and is grounded via the second resistor R2. The second input terminal V1 of the comparator U1 receives the reference voltage. The output terminal of the comparator U1 is connected to the input terminal of the first voltage source 330. The comparator U1 compares a voltage of the first input terminal V2 with a voltage of the second input terminal V1, generates a control signal based on the comparison result, and outputs the control signal to the first voltage source 330.

The first voltage source 330 comprises a first output terminal (node A) connected to the gate drive circuit of the display panel and a second output terminal (node B) connected to the control terminal of the temperature sensing unit 310. The first voltage source 330 generates a corresponding driving voltage based on the control signal, and outputs the driving voltage to the gate drive circuit 106 via the first output terminal. In addition, the first voltage source 330 also generates a feedback signal based on the control signal, outputs the feedback signal to the control terminal of the temperature sensing unit 310 via the second output terminal, further controlling the operation of the temperature sensing unit 310. In addition, the feedback signal is input to the second input terminal V1 of the comparator U1 via the fourth resistor R4 as the reference voltage of the comparator U1. The second input terminal V1 of the comparator U1 is further grounded via the fifth resistor R5.

Hereinafter, operations of the temperature compensation circuit according to an embodiment of the present disclosure will be described in detail with reference to FIG. 4. As shown in FIG. 4, a temperature compensation circuit according to the embodiment of the present disclosure may comprise a temperature sensing unit 410, a temperature compensation control unit 420, a first voltage source 430, and a second voltage source 440. For the sake of brevity, the same technical content as described with reference to FIG. 3 will be omitted.

In FIG. 4, the temperature sensing unit 410 is shown as an array of a plurality of thin film transistors, and the common gate of the thin film transistors is a control terminal of the temperature sensing unit 410. Although the thin film transistor array in FIG. 4 is shown to have a common source as an input terminal and a common drain as an output terminal, it will be understood by the skilled in the art that according to the embodiment of the present disclosure, the source and the drain of the thin film transistor are symmetrical, and may be interchangeable.

The first voltage source 430 in FIG. 4 is shown as a charge pump circuit comprising a charge pump U2, a transistor Q4 and a seventh resistor R7 connected between a base and an emitter of the transistor Q4. One terminal of the charge pump U2 is connected to the output terminal of the comparator U1, and the other terminal of U2 is connected to the base of the transistor Q4; the emitter of the transistor Q4 is connected to the gate drive circuit 106 as a first output terminal (node A), a collector of the transistor Q4 is connected to the common gate (node B) of the thin film transistor array as a second output terminal. The common source of the thin film transistor array is connected to the first resistor R1 in the second voltage source 440, and the common drain is connected to an in-phase terminal (+) of the comparator U1 via the third resistor R3 and is grounded via the second resistor R2. The collector of the transistor Q4 is also connected to an out-of-phase terminal (−) of the comparator U1 via the fourth resistor R4, and the out-of-phase terminal of the comparator U1 is grounded via the fifth resistor R5. Although the thin film transistor array has better performance, the thin film transistor array may be equivalent to a single thin film transistor. For convenience of description, the common gate, the common source and the common drain of the thin film transistor array are referred to as the gate, the source and the drain below.

According to the embodiment of the present disclosure, the thin film transistor for temperature sensing is in a turn-on state, and the transistor Q4 is in an amplified state. The skilled in the art may set resistance values of the first resistor R1 to the fifth resistor R5, or ratios among the resistance values of R1 to R5, so that at a normal temperature at which the TFT of the gate drive circuit 106 works normally, a turn-on current of the thin film transistor for temperature sensing is stable, the emitter of the transistor Q4 supplies an initial gate driving voltage to the gate drive circuit 106 (i.e., the voltage required for turning on the gate of the gate drive circuit at the normal temperature), and the input voltage of the in-phase terminal of the comparator U1 is equal to the input voltage of the out-of-phase terminal thereof. At this time, based on the input voltage of the in-phase terminal being equal to the input voltage of the out-of-phase terminal, the comparator U1 outputs the control signal indicating that the driving voltage of the gate drive circuit 106 is not required to be compensated. According to the control signal, the charge pump circuit does not compensate for the initial gate driving voltage. Therefore, the emitter voltage of the transistor Q4 is the initial gate driving voltage which is not compensated, and the initial gate driving voltage is continuously output to the gate drive circuit 106. In addition, a collector current of the transistor Q4 is output as a feedback signal to the gate of the temperature sensing thin film transistor, and is fed back to the out-of-phase terminal of the comparator U1 via the fourth resistor R4. Since the ambient temperature is in a normal range at this time, the turn-on resistance of the temperature sensing thin film transistor thus the turn-on current is stable, so that the drain voltage of the temperature sensing thin film transistor is stable. Therefore, the input voltages of the in-phase terminal and the out-of-phase terminal of the comparator U1 are kept unchanged, and the entire temperature compensation circuit is in a stable equilibrium state. Parameters of the feedback signal may be set according to characteristics of a Temperature-Turn-on curve of the temperature sensing unit.

When the ambient temperature of the display panel is reduced, the equivalent turn-on resistance Rref of the thin film transistor array in the temperature sensing unit 410 is increased, resulting in a decrease in an equivalent turn-on current of the thin film transistor and a reduction of the drain voltage (the voltage at node C, i.e., the temperature sensed output voltage), so that the input voltage of the in-phase terminal of the comparator U1 is reduced. Since the input voltage of the in-phase terminal becomes smaller than the input voltage of the out-of-phase terminal at this time, the comparator U1 outputs a control signal indicating that the initial gate driving voltage needs to be compensated, based on the comparison result. Based on the control signal, the charge pump circuit U2 compensates for the initial gate driving voltage in which the base voltage of the transistor Q4 is increased, the emitter voltage is increased, and the increased emitter voltage is output as the gate driving voltage to the gate drive circuit 106, thereby implementing temperature compensation for the gate driving voltage. At this time, the collector current of the transistor Q4 is increased, and the increased collector current is output as the feedback signal to the gate of the temperature sensing thin film transistor, so that the gate voltage of the thin film transistor is increased, and thus the turn-on current of the thin film transistor is increased. As such, the turn-on resistance of the thin film transistor being increased and thus the turn-on current being decreased due to the reduction of the ambient temperature are compensated. Since the turn-on current of the temperature sensing thin film transistor is increased, the input voltage of the in-phase terminal of the comparator U1 is increased, and the comparator U1 continues to compare the input voltage of the in-phase terminal with the input voltage of the out-of-phase terminal. If the input voltage of the in-phase terminal is still less than the input voltage of the out-of-phase terminal, the above operations are repeated, further compensating the gate driving voltage, until the input voltage of the in-phase terminal is equal to the input voltage of the out-of-phase terminal, thereby the entire circuit enters the stable equilibrium state again. In practical applications, it may be necessary to compensate for the gate driving voltage several times in order to make the entire circuit again into the stable equilibrium state.

In addition, since the collector current of the transistor Q4 is also fed back to the out-of-phase terminal of the comparator U1 via the fourth resistor R4, the input voltage of the out-of-phase terminal of the comparator U1, as the reference voltage, is slightly increased due to the collector current being increased, but is not fixed to be constant. Therefore, compared to the conventional technique in which the reference voltage of the comparator is fixed, the reference voltage of the comparator according to the embodiment of the present disclosure is variable based on the feedback signal which is output from the comparator, so that the compensated voltage value can be adjusted more flexibly.

Figure 5:
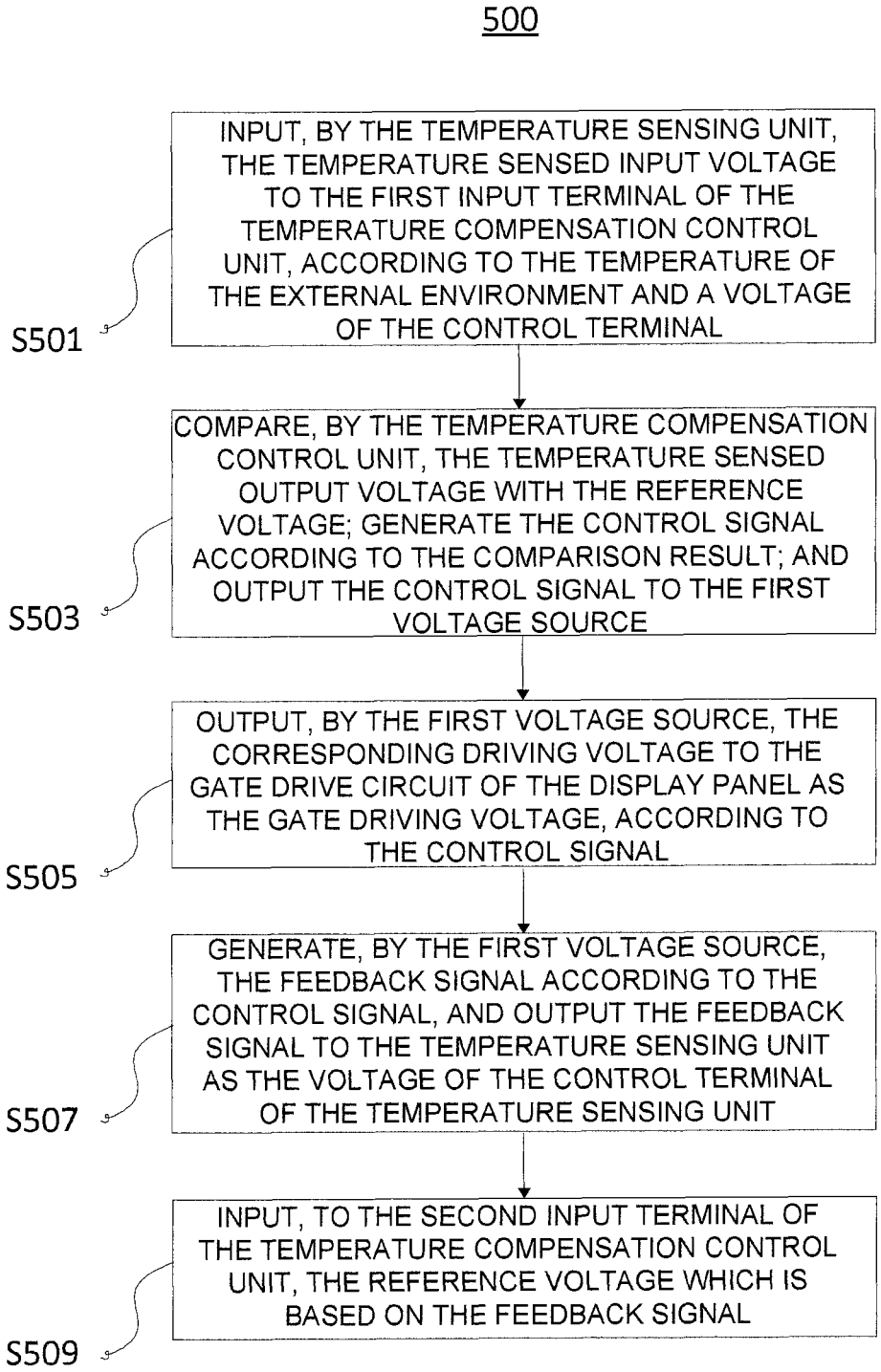
FIG. 5 shows a flowchart of a temperature compensation method according to an embodiment of the present disclosure.

Next, a temperature compensation method according to an embodiment of the present disclosure will be described with reference to FIG. 5, which may be applied to the temperature compensation circuit according to the embodiment of the present disclosure. As shown in FIG. 5, the temperature compensation method 500 according to the embodiment of the present disclosure may comprise:

Step 501 of inputting, by the temperature sensing unit, the temperature sensed input voltage to the first input terminal of the temperature compensation control unit, according to the temperature of the external environment and a voltage of the control terminal;

Step 503 of comparing, by the temperature compensation control unit, the temperature sensed output voltage with the reference voltage; generating the control signal according to the comparison result; and outputting the control signal to the first voltage source;

Step 505 of outputting, by the first voltage source, the corresponding driving voltage to the gate drive circuit of the display panel as the gate driving voltage, according to the control signal;

Step 507 of generating, by the first voltage source, the feedback signal according to the control signal, and outputting the feedback signal to the temperature sensing unit as the voltage of the control terminal of the temperature sensing unit; and Step 509 of inputting, to the second input terminal of the temperature compensation control unit, the reference voltage which is variable based on the feedback signal.

In particular, Step 505 may comprise: generating a control signal which indicates that the first voltage source needs to compensate for the gate driving voltage, when the temperature compensation control unit determines that the temperature sensed output voltage is less than the reference voltage; and generating a control signal which indicates that the first voltage source does not need to compensate for the gate driving voltage, when the temperature compensation control unit determines that the temperature sensed output voltage is no less than the reference voltage. It should be noted that the initial gate driving voltage is a voltage required for turning on the gate of the gate drive circuit at the normal temperature, and at this time the in-phase terminal and the out-of-phase terminal of the comparator U1 are equal. It can be understood that the initial gate driving voltage is a gate driving voltage at which the first voltage source performs the temperature compensation for the first time.

In particular, Step 507 may comprise: generating, by the first voltage source, the feedback signal according to the control signal, so as to increase the voltage of the control terminal; and inputting an increased reference voltage to the second input terminal of the temperature compensation control unit, based on the feedback signal.

According to the embodiments of the present disclosure, since the temperature sensing element in the temperature compensation circuit is formed on the liquid crystal panel, the temperature sensing unit and the switch TFT in the gate drive circuit are in the same environment, compared to the temperature sensing element in the temperature compensation circuit being formed on the PCB of the display panel. Therefore, the ambient environment of the display panel may be reflected more objectively, which can improve sensitivity and accuracy of the temperature compensation unit, and reduce the possibility of abnormal screen due to the ambient temperature being too low.

According to the embodiments of the present disclosure, the temperature sensing element may use a temperature sensing TFT of the same specification as the gate drive TFT of the gate drive circuit. In this case, since the temperature sensing TFT and the gate drive TFT have the same characteristic curves, they can respond to the variation of the external temperature consistently, so as to improve the accuracy of the temperature compensation. Alternatively, the temperature sensing TFT may be formed together with the gate drive TFT.

According to the embodiments of the present disclosure, a plurality of temperature sensing TFTs may be uniformly arranged on the non-display region of the display panel in a form of an array. Compared to the case that a single TFT is used as the temperature sensing element, the TFT array of the temperature sensing unit can reflect the ambient temperature of the display panel (thus the gate drive circuit) more objectively since the TFT array of the temperature sensing unit has a larger distribution area. In addition, even in a case that some one or even more temperature sensing TFTs of the temperature sensing unit are disabled, other TFTs can accurately sense the variation of the ambient temperature, which improves the robustness of the circuit. In addition, the resistance value of the turn-on resistance of the equivalent TFT consisting of the plurality of TFTs is an average of the resistance values of the plurality of TFTs. Thus, the reflection on the temperature change is more accurate, and the turn-on current is more stable.

According to the embodiments of the present disclosure, when the temperature is reduced, the first voltage source generates the feedback signal based on the control signal of the comparator, the feedback signal causing the voltage of the reference voltage input terminal (in the embodiments, the out-of-phase terminal) of the comparator to be increased. Compared to the conventional technique in which the reference voltage of the comparator is fixed, the reference voltage of the comparator is variable based on the feedback signal which is output from the comparator, so that the compensated voltage value can be adjusted more flexibly.

It may be understood that the above implementations are only exemplary implementations for illustrating the principles of the present disclosure, but the present disclosure is not limited to these. For the skilled in the art, various variations and improvements may be made without being apart from the sprit and substance of the present disclosure, which also fall into the protection scope of the present disclosure.

We claim:

1. A temperature compensation circuit, comprising:

a temperature sensing unit, adapted to sense a temperature of an external environment and generate a temperature sensed output voltage based on the sensed temperature of the external environment;

a temperature compensation control unit connected to the temperature sensing unit, the temperature compensation control unit being adapted to compare the temperature sensed output voltage with a reference voltage, and generate a control signal based on the comparison result; and a first voltage source connected to the temperature compensation control unit and the temperature sensing unit, the first voltage source adapted to receive a control signal from the temperature compensation control unit, generate a corresponding driving voltage based on the control signal and output the corresponding driving voltage to a gate drive circuit as a gate driving voltage of the gate drive circuit, and generate a feedback signal according to the control signal and output the feedback signal to the temperature sensing unit and the temperature compensation control unit, the reference voltage being variable based on the feedback signal;

wherein the temperature sensing unit comprises a control terminal, an input terminal and an output terminal; the temperature compensation control unit comprises a first input terminal, a second input terminal and an output terminal; and the first voltage source comprises an input terminal, a first output terminal and a second output terminal, wherein the first input terminal of the temperature compensation control unit is connected to the output terminal of the temperature sensing unit, the second input terminal of the temperature compensation control unit is connected to the control end of the temperature sensing unit, and the output terminal of the temperature compensation control unit is connected to the input terminal of the first voltage source, and wherein the temperature compensation control unit compares an input voltage of its first input terminal with an input voltage of its second input terminal; and the first output terminal of the first voltage source is connected to the gate drive circuit, the second output terminal of the first voltage source is connected to the control terminal of the temperature sensing unit and the second input terminal of the temperature compensation control unit, and the first voltage source outputs the corresponding driving voltage to the gate drive circuit via the first output terminal and outputs the feedback signal to the control terminal of the temperature sensing unit and the second input terminal of the temperature compensation control unit via the second output terminal.

2. The temperature compensation circuit of claim 1, further comprising a second voltage source connected to the input terminal of the temperature sensing element, adapted to provide a constant operating voltage to the temperature sensing unit.

3. The temperature compensation circuit according to claim 1, wherein the temperature sensing unit comprises a plurality of temperature sensing elements which are thin film transistors, gates, sources and drains of the thin film transistors being respectively connected together to form a common gate, a common source and a common drain respectively, the common gate of the thin film transistors being the control terminal of the temperature sensing unit, one of the common source and the common drain of the thin film transistors being the input terminal of the temperature sensing unit, and the other of the common source and the common drain of the thin film transistors being the output terminal of the temperature sensing unit.

4. The temperature compensation circuit according to claim 3, wherein the first voltage source comprises a charge pump circuit which generates the corresponding driving voltage based on the control signal and outputs to the gate drive circuit, and generates the feedback signal according to the control signal and outputs to the control terminal of the temperature sensing unit and the second input terminal of the temperature compensation control unit.

5. The temperature compensation circuit of claim 3, wherein the temperature compensation control unit comprises a comparator, an in-phase input terminal of the comparator receiving the temperature sensed output voltage from the temperature sensing unit, an out-of-phase input terminal of the comparator receiving the reference voltage, and an output terminal of the comparator outputting the control signal.

6. The temperature compensation circuit according to claim 5, wherein the temperature compensation control unit further comprises a third resistor and a fourth resistor, the control terminal of the temperature sensing unit being connected to the out-of-phase input terminal of the comparator via the fourth resistor, and the output terminal of the temperature sensing unit being connected to the in-phase input terminal of the comparator via the third resistor.

7. The temperature compensation circuit according to claim 6, wherein the temperature compensation control unit further comprises a second resistor and a fifth resistor, the output terminal of the temperature sensing unit being grounded via the second resistor, and the out-of-phase input terminal of the comparator being grounded via the fifth resistor.

8. A display panel comprising a display region and a non-display region, wherein the display panel further comprises:

the temperature compensation circuit according to claim 1, adapted to perform temperature compensation for the gate driving voltage of the gate drive circuit of the display panel, wherein the temperature sensing unit is arranged in the non-display region of the display panel.

9. The display panel according to claim 8, wherein the temperature sensing unit comprises a plurality of thin film transistors which are uniformly arranged in the non-display region in a form of an array.

10. A temperature compensation method applied for the gate driving voltage of the display panel according to claim 8, comprising:

inputting, by the temperature sensing unit, the temperature sensed input voltage to the first input terminal of the temperature compensation control unit, according to the temperature of the external environment and a voltage of the control terminal;

comparing, by the temperature compensation control unit, the temperature sensed output voltage with the reference voltage; generating the control signal according to the comparison result; and outputting the control signal to the first voltage source;

outputting, by the first voltage source, the corresponding driving voltage to the gate drive circuit of the display panel as the gate driving voltage, according to the control signal;

generating, by the first voltage source, the feedback signal according to the control signal, and outputting the feedback signal to the temperature sensing unit as the voltage of the control terminal of the temperature sensing unit; and inputting, to the second input terminal of the temperature compensation control unit, the reference voltage which is variable based on the feedback signal.

11. The method according to claim 10, wherein generating, by the temperature compensation control unit, the control signal according to the comparison result comprises: generating a control signal which indicates that the first voltage source needs to compensate for the gate driving voltage, when the temperature compensation control unit determines that the temperature sensed output voltage is less than the reference voltage; and generating a control signal which indicates that the first voltage source does not need to compensate for the gate driving voltage, when the temperature compensation control unit determines that the temperature sensed output voltage is no less than the reference voltage.

12. The method according to claim 11, wherein the first voltage source generates the feedback signal according to the control signal, so as to increase the voltage of the control terminal; and inputs an increased reference voltage to the second input terminal of the temperature compensation control unit, based on the feedback signal.

13. The display panel according to claim 8, wherein the non-display region is glass of the display panel.

14. The temperature compensation circuit according to claim 1, wherein a parameter of the feedback signal is set according to characteristics of a Temperature-Turn-on curve of the temperature sensing unit.

* * * * *